US009035850B2

(12) United States Patent
Liu et al.

(10) Patent No.: US 9,035,850 B2
(45) Date of Patent: May 19, 2015

(54) METAMATERIAL FOR DIVERGING AN ELECTROMAGNETIC WAVE

(75) Inventors: Ruopeng Liu, Guangdong (CN); Chunlin Ji, Guangdong (CN); Yutao Yue, Guangdong (CN); Yunnan Hong, Guangdong (CN)

(73) Assignees: KUANG-CHI INNOVATIVE TECHNOLOGY LTD., FuTian District, Shenzhen, Guangdong (CN); KUANG-CHI INSTITUTE OF ADVANCED TECHNOLOGY, High-Tech Industrial Estate, Nanshan District, Shenzhen, Guangdong (CN)

( * ) Notice: Subject to any disclaimer, the term of this patent is extended or adjusted under 35 U.S.C. 154(b) by 372 days.

(21) Appl. No.: 13/521,743

(22) PCT Filed: Nov. 24, 2011

(86) PCT No.: PCT/CN2011/082839

§ 371 (c)(1), (2), (4) Date: Jul. 12, 2012

(87) PCT Pub. No.: WO2013/026238

PCT Pub. Date: Feb. 28, 2013

(65) Prior Publication Data

US 2013/0050058 A1 Feb. 28, 2013

(30) Foreign Application Priority Data

Aug. 23, 2011 (CN) ..... 2011 1 0242684

(51) Int. Cl.
*H01Q 15/02* (2006.01)
*H01Q 15/00* (2006.01)

(52) U.S. Cl.
CPC ..... *H01Q 15/0086* (2013.01)

(58) Field of Classification Search
CPC ..... H01Q 15/0086
USPC ..... 343/909
See application file for complete search history.

(56) References Cited

U.S. PATENT DOCUMENTS

| | | | | |
|---|---|---|---|---|
| 2009/0040132 | A1 * | 2/2009 | Sridhar et al. | 343/911 R |
| 2010/0027102 | A1 * | 2/2010 | Hyde et al. | 359/333 |
| 2010/0067091 | A1 * | 3/2010 | Smith et al. | 359/278 |

* cited by examiner

*Primary Examiner* — Robert Karacsony
(74) *Attorney, Agent, or Firm* — Winston Hsu; Scott Margo

(57) ABSTRACT

The present disclosure relates to a metamaterial for diverging an electromagnetic wave, which comprises at least one metamaterial sheet layer. Refractive indices of the metamaterial sheet layer are distributed in a circular form with a center of the metamaterial sheet layer, and the refractive indices remain unchanged at a same radius and increase gradually with the radius. The present disclosure changes electromagnetic parameters at each point of the metamaterial through punching or by attaching man-made microstructures so that the electromagnetic wave can be diverged after passing through the metamaterial. The metamaterial of the present disclosure features a simple manufacturing process and a low cost, and is easy to be implemented. Moreover, the metamaterial of the present disclosure has small dimensions and does not occupy a large space, so it is easy to miniaturize apparatuses made of the metamaterial of the present disclosure.

11 Claims, 6 Drawing Sheets

METAMATERIAL FOR DIVERGING AN ELECTROMAGNETIC WAVE

FIELD OF THE INVENTION

The present disclosure generally relates to a metamaterial, and more particularly, to a metamaterial for diverging an electromagnetic wave.

BACKGROUND OF THE INVENTION

Apparatuses such as divergent antennae that are made of conventional materials can diverge electromagnetic waves, but have the following shortcomings: the volume thereof is bulky, which is unfavorable for miniaturization; they rely on the shape thereof heavily, which makes it difficult to design these apparatuses flexibly; and they suffer from a considerable loss and the media used are liable to aging, so the cost is high.

Nowadays, metamaterials are receiving increasing attention as a kind of new materials. The metamaterials refer to man-made composite structures or composite materials having supernormal physical properties that natural materials lack. Through structurally ordered design of critical physical dimensions of the materials, restrictions of some apparent natural laws can be overcome to obtain supernormal material functions that natural materials lack.

"Metamaterials" that have been developed so far include "left-handed materials", "photonic crystals", "meta-magnetic materials" and the like. Properties of the metamaterials are usually not primarily determined by intrinsic properties of the constitutional material, but by the man-made structures formed therein.

In order to achieve divergence of an electromagnetic wave, the following indicators among others must be satisfied:

1) High performance. The electromagnetic wave shall be diverged at high performances to approximate the desired divergence state.

2) Low loss. Energy of the electromagnetic wave shall be diverged at a high diverging efficiency to achieve the goal of energy saving.

3) Small dimensions. That is, the apparatuses shall not occupy a large space.

Furthermore, the method of diverging the electromagnetic wave shall be easy to be implemented without a complex design, and the cost of components shall not be too high.

SUMMARY OF THE INVENTION

In view of the aforesaid shortcomings of the prior art, an objective of the present disclosure is to provide a metamaterial for diverging an electromagnetic wave that features a simple manufacturing process and a low cost and that is easy to be implemented.

To achieve the aforesaid objective, the present disclosure provides a metamaterial for diverging an electromagnetic wave, which comprises at least one metamaterial sheet layer. Refractive indices of the metamaterial sheet layer are distributed in a circular form about a center of the metamaterial sheet layer, and the refractive indices remain unchanged at a same radius and increase gradually with the radius.

Preferably, the refractive indices increase with the radius in a linear way, a squared way or a cubic way.

Preferably, the metamaterial sheet layer comprises a plurality of metamaterial units, each of the metamaterial units comprises a substrate and microstructures disposed on the substrate.

Preferably, the microstructures are metal microstructures.

Preferably, for a same one of the metamaterial sheet layer, the metal microstructures located at a same radius have the same geometric dimensions, the geometric dimensions of the metal microstructures increase gradually with the radius, and the radius represents a distance from a center of the respective metamaterial unit to the center of the metamaterial sheet layer.

Preferably, the metal microstructures are in a planar snowflake form, a derivative structure of the planar snowflake form, an "⌶" form, or a derivative structure of the "⌶" form.

Preferably, the metal microstructures are attached on the substrate through etching, electroplating, drilling, photolithography, electron etching or ion etching.

Preferably, the microstructures are man-made pores.

Preferably, for a same one of the metamaterial sheet layer, all the man-made pores are filled with a medium material having a refractive index which is smaller than that of the substrate, each of the metamaterial units comprises one man-made pore, the man-made pores of the metamaterial units at a same radius have a same volume, the man-made pores gradually decrease in volume as the radius increases, and the radius to represents a distance from the respective metamaterial unit to the center of the metamaterial sheet layer.

Preferably, for a same one of the metamaterial sheet layer, all the man-made pores are formed of unit pores having a same volume and are filled with a medium material having a refractive index which is smaller than that of the substrate, a total volume of the man-made pores is the same for each of the metamaterial units at a same radius, the number of the unit pores in each of the man-made pores decreases gradually as the radius increases, and the radius represents a distance from the respective metamaterial unit to the center of the metamaterial sheet layer.

Preferably, for a same one of the metamaterial sheet layer, all the man-made pores are filled with a medium material having a refractive index which is greater than that of the substrate, each of the metamaterial units comprises one man-made pore, the man-made pores of the metamaterial units at a same radius have the same volume, the man-made pores gradually increase in volume as the radius increases, and the radius represents a distance from the respective metamaterial unit to the center of the metamaterial sheet layer.

Preferably, for a same one of the metamaterial sheet layer, all the man-made pores are formed of unit pores having a same volume and are filled with a medium material having a refractive index which is greater than that of the substrate, a total volume of the man-made pores is the same for each of the metamaterial units at a same radius, the number of the unit pores in each of the man-made pores increases gradually as the radius increases, and the radius represents a distance from the respective metamaterial unit to the center of the metamaterial sheet layer.

Preferably, for a same one of the metamaterial sheet layer, the man-made pores all have a same volume, the medium material filled at a same radius has the same refractive index, the refractive index of the medium material filled in the man-made pores increases gradually with the radius, and the radius represents a distance from the respective metamaterial unit to the center of the metamaterial sheet layer.

Preferably, the man-made pores are any or a combination of cylindrical pores, conical pores, circular-truncated-cone-like pores, trapezoidal pores and square pores.

Preferably, the man-made pores are formed on the substrate through high-temperature sintering, injection molding, stamping, or digitally controlled punching.

Preferably, the substrate is made of a ceramic material, a polymer material, a ferro-electric material, a ferrite material or a ferro-magnetic material.

Preferably, the polymer material includes polytetrafluoroethylene (PTFE), an epoxy resin, an F4B composite material or an FR-4 composite material.

Preferably, each of the metamaterial units is of a cubic or cuboidal form, and none of a length, a width and a height of the metamaterial unit is greater than one fifth of a wavelength of the incident electromagnetic wave.

The present disclosure changes electromagnetic parameters at each point of the metamaterial through punching or by attaching man-made microstructures so that the electromagnetic wave can be diverged after passing through the metamaterial. The metamaterial of the present disclosure features a simple manufacturing process and a low cost, and is easy to be implemented. Moreover, the metamaterial of the present disclosure has small dimensions and does not occupy a large space, so it is easy to miniaturize apparatuses made of the metamaterial of the present disclosure.

DETAILED DESCRIPTION OF THE INVENTION

Hereinbelow, the present disclosure will be described in detail with reference to the attached drawings and embodiments thereof.

Figure 1:
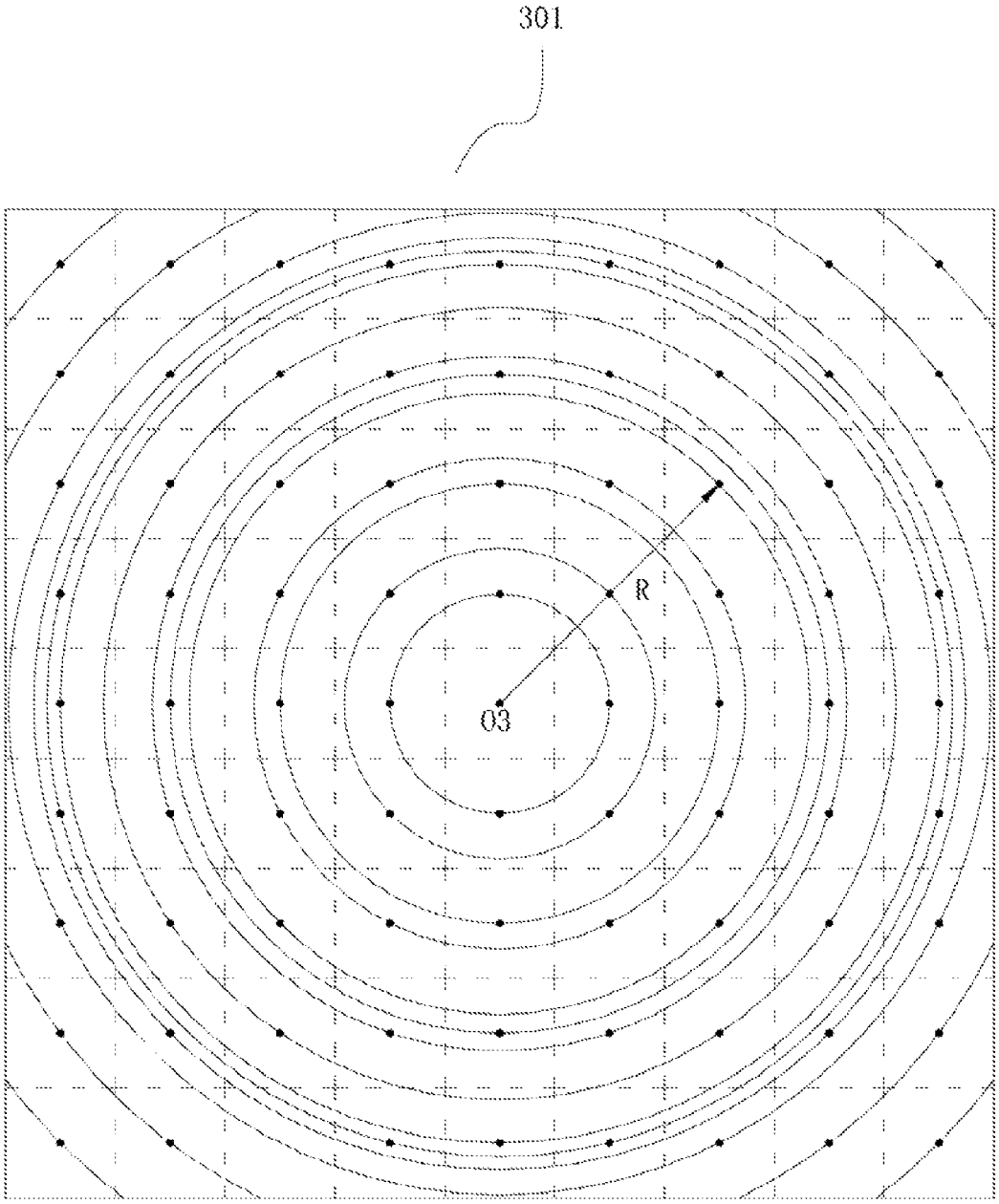
FIG. 1 is a schematic view illustrating the refractive index distribution of a metamaterial for diverging an electromagnetic wave of the present disclosure.

In the present disclosure, the refractive indices of the metamaterial 301 are shown in FIG. 1. The refractive indices of the metamaterial 301 are distributed in a circular form with a center O3 of the metamaterial 301, and the refractive indices remain unchanged at a same radius and increase gradually with the radius.

The refractive indices of the metamaterial 301 may vary in a linear way; that is, $n_R=n_{min}+KR$, where K represents a constant, R represents a radius (with the center O3 of the metamaterial 301 as a circle center), and $n_{min}$ represents the minimum refractive index of the metamaterial 301 (i.e., the refractive index at the center O3 of the metamaterial 301). Additionally, the refractive indices of the metamaterial 301 may also vary in a squared way (i.e., $n_R=n_{min}+KR^2$), a cubic way (i.e., $n_R=n_{min}+KR^3$), or according to a power function (i.e., $n_R=n_{min}*K^R$).

Figure 2:
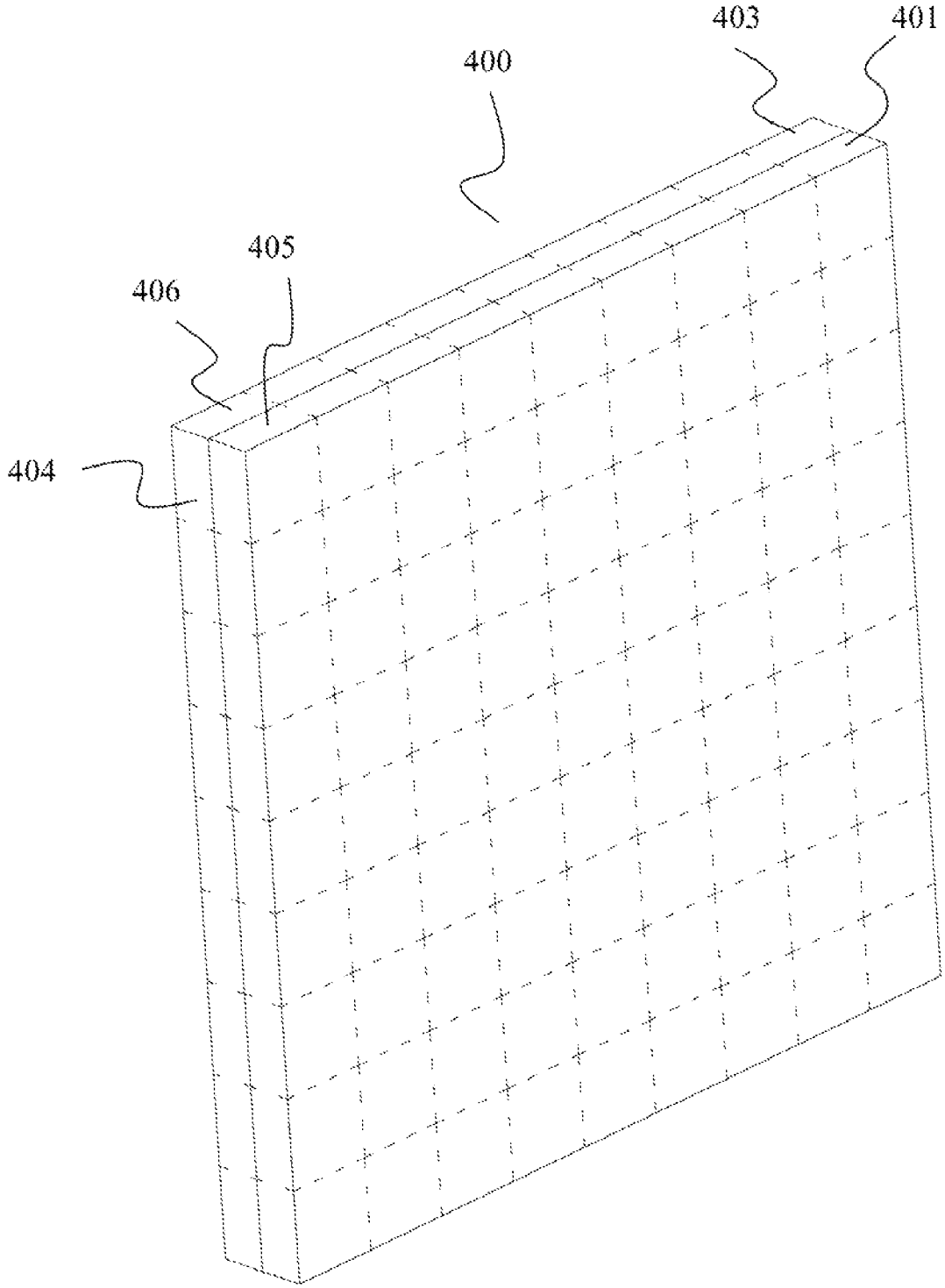
FIG. 2 is a schematic structural view of an implementation of a metamaterial sheet layer according to the present disclosure.
Figure 3:
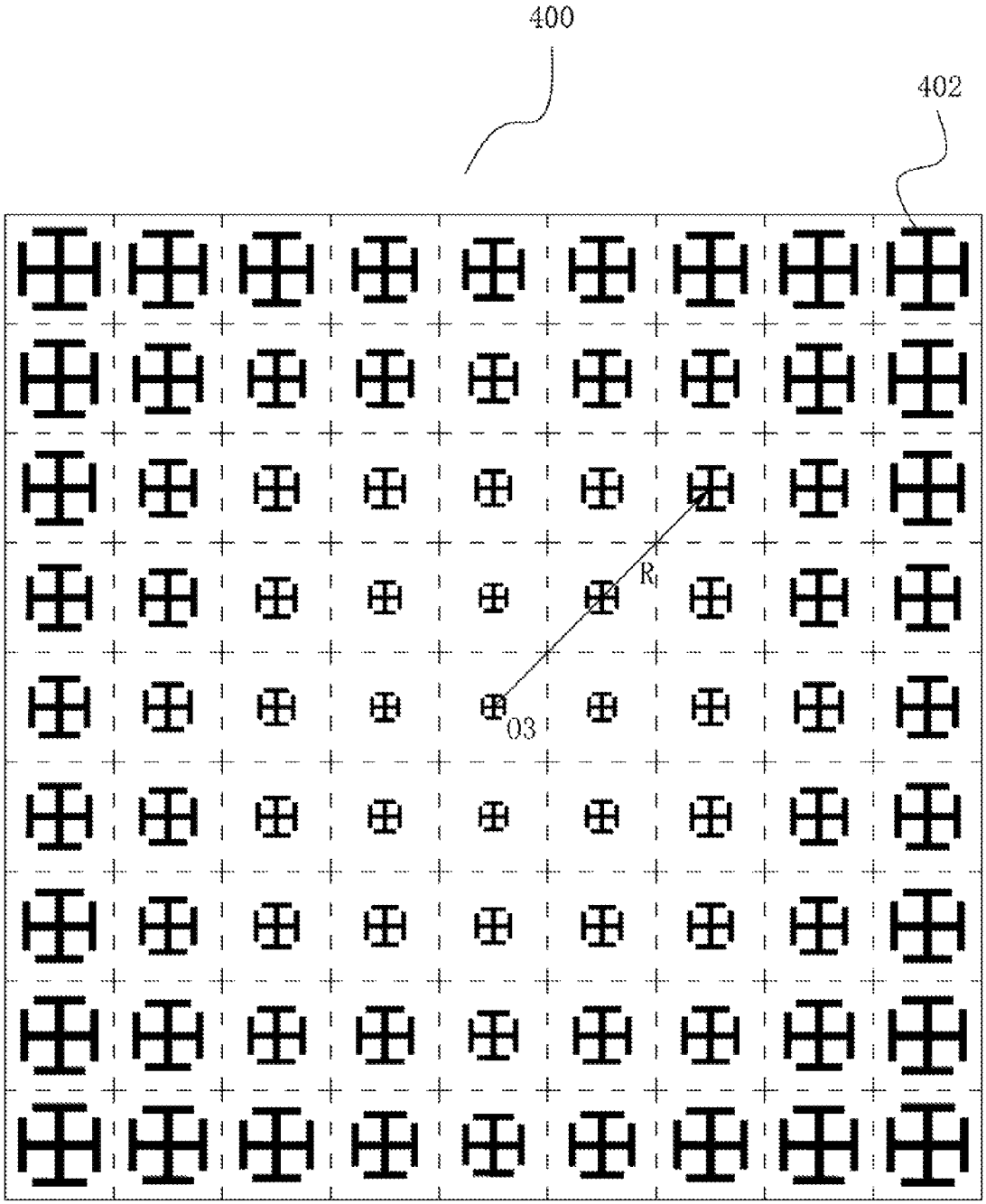
FIG. 3 is a front view of FIG. 2 after a substrate is removed.

FIG. 2 illustrates an implementation of a metamaterial that has the refractive index distribution shown in FIG. 1. The metamaterial comprises a metamaterial sheet layer 400. As shown in FIG. 2 and FIG. 3, the metamaterial sheet layer 400 comprises a sheet substrate 401, metal microstructures 402 attached on the substrate 401 and a support layer 403 covering the metal microstructures 402. The metamaterial sheet layer 400 may be divided into a plurality of identical metamaterial units 404, each of which comprises a metal microstructure 402, a substrate unit 405 that are occupied by the metal microstructure 402 and a support layer unit 406. The metamaterial sheet layer 400 has only one metamaterial unit 404 in the thickness direction. The metamaterial units 404 may be squares, cubes or cuboids that are completely identical to each other. A length, a width and a height of each of the metamaterial units 404 are all smaller than or equal to one fifth of a wavelength of the incident electromagnetic wave (usually one tenth of the wavelength of the incident electromagnetic wave) so that the entire metamaterial has a to continuous response to the electric field and/or the magnetic field of the electromagnetic wave. Preferably, each of the metamaterial units 404 is a cube whose side length is one tenth of the wavelength of the incident electromagnetic wave. Preferably, each of the metamaterial units 404 of the present disclosure has a structure as shown in FIG. 2.

FIG. 3 is a front view of FIG. 2 after the substrate is removed. Spatial arrangement of the metal microstructures 402 can be clearly seen from FIG. 3. Taking the center O3 of the metamaterial sheet layer 400 as a circle center (the center O3 here is located at a midpoint of the midmost metal microstructure), the metal microstructures 402 located at a same radius have the same geometric dimensions, and the geometric dimensions of the metal microstructures 402 increase gradually with the radius. The radius here refers to a distance from the respective metamaterial unit 404 to the center of the metamaterial sheet layer 400.

The substrate 401 of the metamaterial sheet layer 400 is made of a ceramic material, a polymer material, a ferro-electric material, a ferrite material or a ferro-magnetic material. The polymer material may be chosen from polytetrafluoroethylene (PTFE), an epoxy resin, an F4B composite material, an FR-4 composite material and the like. For example, PTFE has excellent electric insulativity, and thus will not cause interference to the electric field of the electromagnetic wave; and PTFE has excellent chemical stability and corrosion resistance, and thus has a long service life.

The metal microstructures 402 are made of metal wires such as copper wires or silver wires. The metal wires may be attached on the substrate through etching, electroplating, drilling, photolithography, electron etching or ion etching. Of course, a three-dimensional (3D) laser machining process may also be used. The metal microstructures 402 may be metal microstructures in a two-dimensional (2D) snowflake form as shown in FIG. 3. Of course, the metal microstructures 402 may also be derivative structures of the metal microstructures of the 2D snowflake form. Further, the metal microstructures 402 may also be metal wires in an "⊥" form, derivative structures of the metal wires in the "⊥" form, or metal wires in a "+" form.

Figure 4:
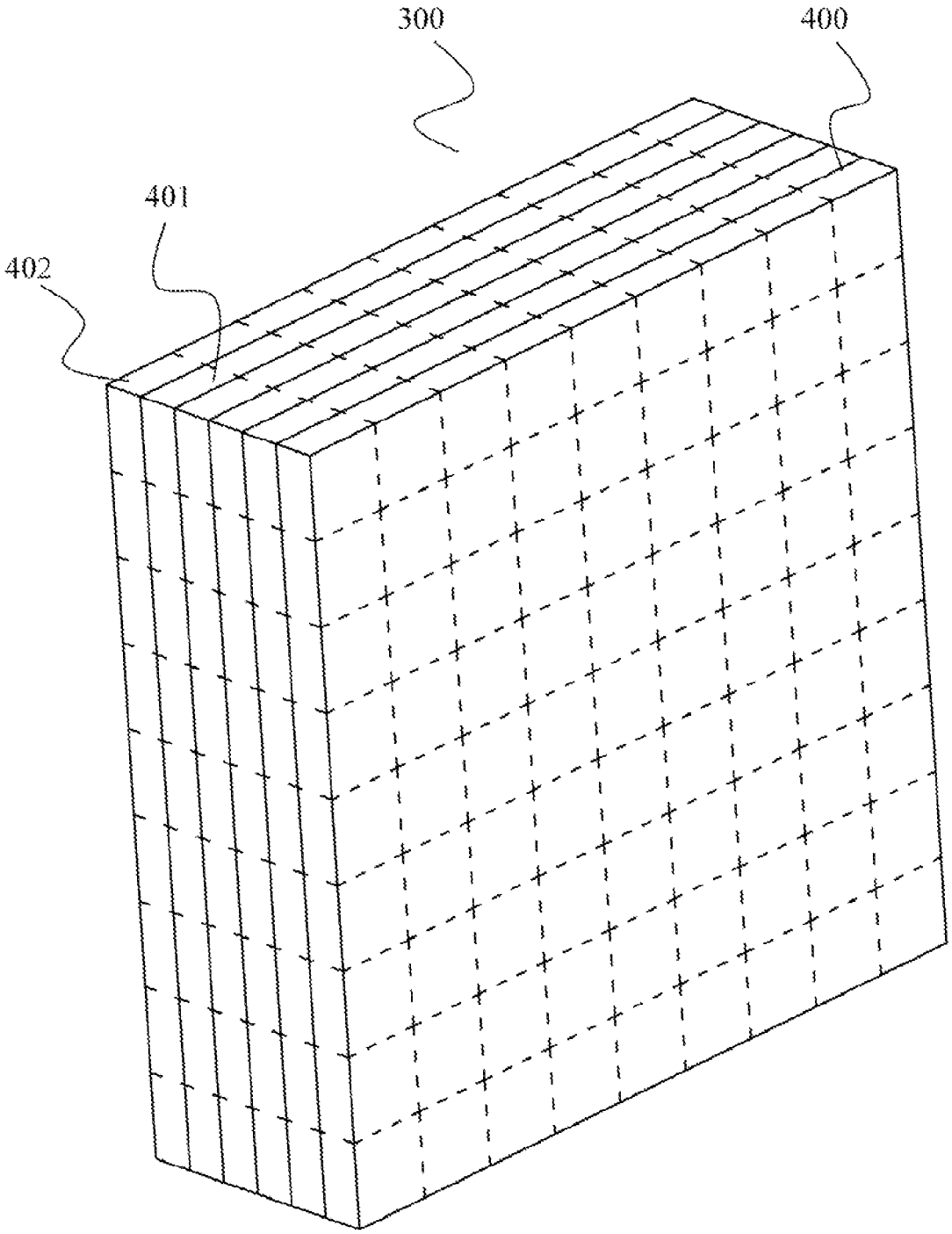
FIG. 4 is a schematic structural view of a metamaterial comprising a plurality of metamaterial sheet layers shown in FIG. 2.

A metamaterial 300 shown in FIG. 4 comprises a plurality of metamaterial sheet layers 400 shown in FIG. 2. There are shown three metamaterial sheet layers. Of course, the metamaterial 300 may be comprised of a different number of metamaterial sheet layers 400 depending on different requirements. The plurality of metamaterial sheet layers 400 are joined closely with each other, and this may be achieved through use of double-sided adhesive tapes or bolts.

Figure 5:
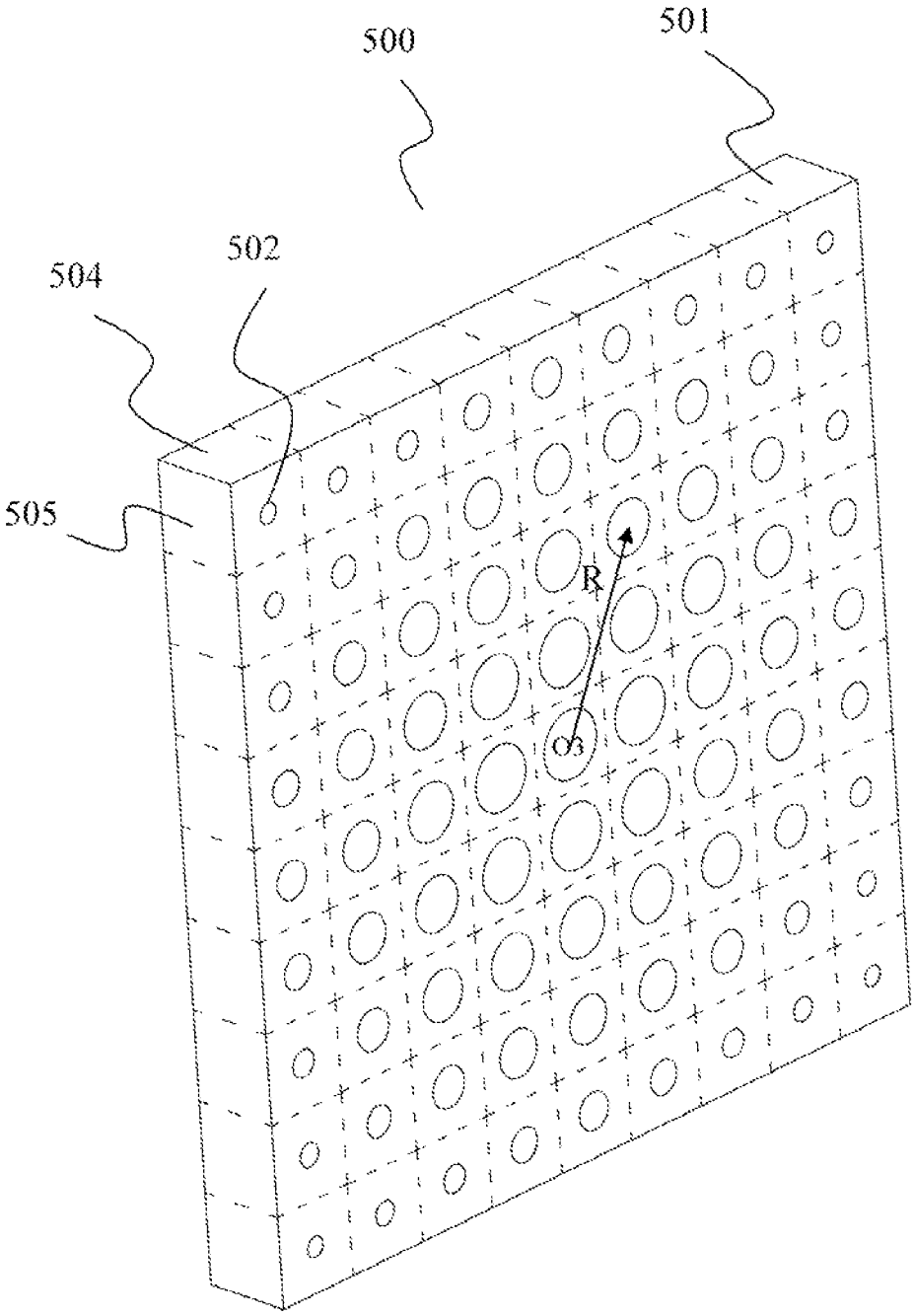
FIG. 5 is a schematic structural view of another implementation of a metamaterial sheet layer according to the present disclosure.

FIG. 5 illustrates another implementation of a metamaterial sheet layer 500 that has the refractive index distribution shown in FIG. 1. The metamaterial sheet layer 500 comprises a sheet substrate 501 and man-made pores 502 formed on the substrate 501. The metamaterial sheet layer 500 may be divided into a plurality of identical metamaterial units 504, each of which comprises a man-made pore 502 and a substrate unit 505 occupied by the man-made pore 502. The metamaterial sheet layer 500 has only one metamaterial unit 504 in the thickness direction. The metamaterial units 504 may be squares, cubes or cuboids that are completely identical to each other. A length, a width and a height of each of the metamaterial units 504 are all smaller than or equal to one fifth of the wavelength of the incident electromagnetic wave (usually one tenth of the wavelength of the incident electromagnetic wave) so that the entire metamaterial sheet layer has a continuous response to the electric field and/or the magnetic field of the electromagnetic wave. Preferably, each of the metamaterial units 504 is a cube whose side length is one tenth of the wavelength of the incident electromagnetic wave.

As shown in FIG. 5, the man-made pores of the metamaterial sheet layer 500 are all cylindrical pores. Taking the center O3 of the metamaterial sheet layer 500 as a circle center (the center O3 here is located in a central axis of the midmost man-made pore), the man-made pores 502 at a same radius have a same volume, and the man-made pores 502 gradually decrease in volume as the radius increases. The radius here refers to a distance from the respective metamaterial unit 504 to the center of the metamaterial sheet layer 500. Therefore, by filling each of the cylindrical pores with a medium material (e.g., air) having a refractive index which is smaller than that of the substrate, the refractive index distribution shown in FIG. 1 can be achieved. Of course, if the to man-made pores 502 at a same radius have a same volume and the man-made pores 502 gradually increase in volume as the radius increases when the center O3 of the metamaterial sheet layer 500 is taken as a circle center, then each of the cylindrical pores must be filled with a medium material having a refractive index greater than that of the substrate in order to achieve the refractive index distribution shown in FIG. 1.

Figure 6:
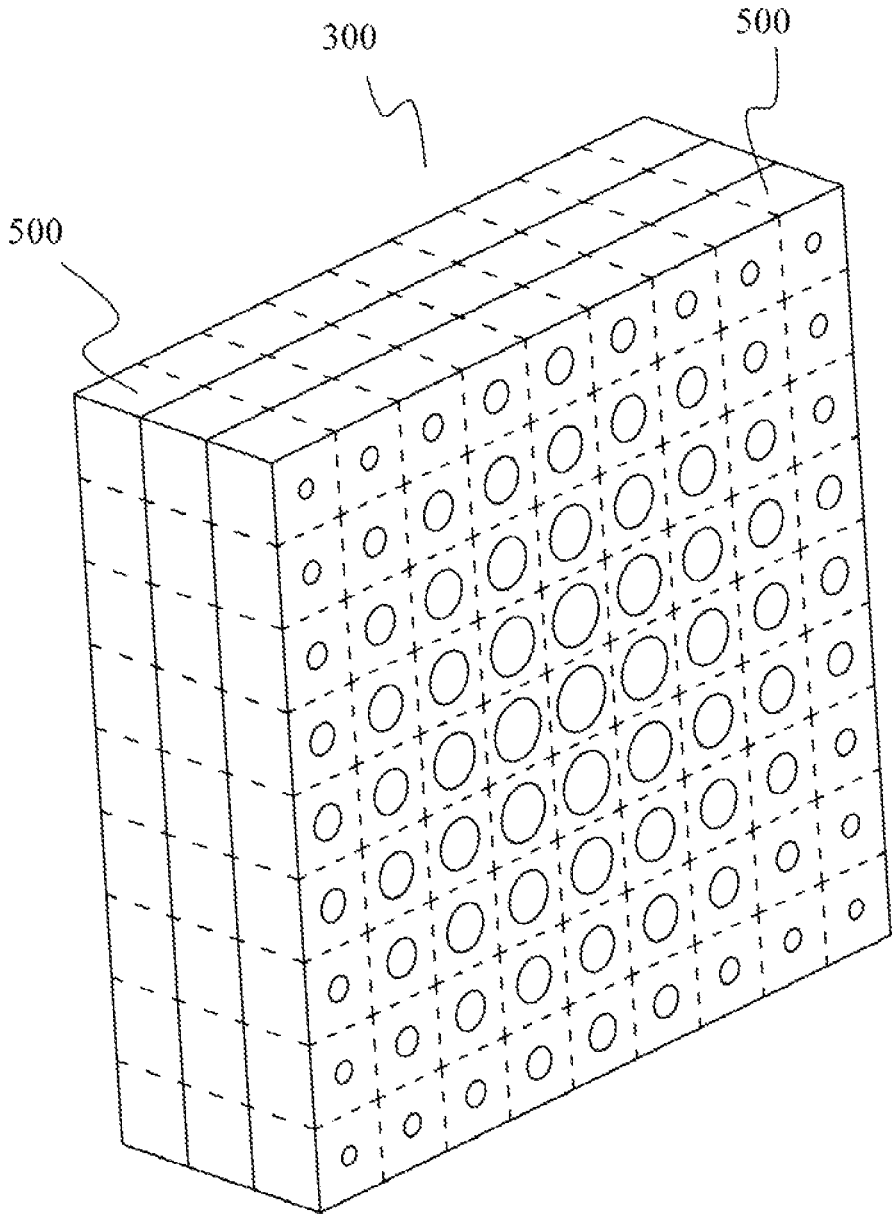
FIG. 6 is a schematic structural view of a metamaterial comprising a plurality of metamaterial sheet layers shown in FIG. 5.

Of course, the metamaterial sheet layer is not merely limited to the aforesaid implementation. As an example, each of the man-made pores may be divided into multiple unit pores having a same volume; and the same objective can also be achieved by controlling the number of the unit pores in each substrate unit to control the volume of the man-made pore of each of the metamaterial units 504. As another example, the metamaterial sheet layer may also be implemented in the following form: all the man-made pores of a same metamaterial sheet layer have a same volume, but the medium material filled in the man-made pores has refractive indices distributed as shown in FIG. 6 (i.e., the medium material filled at a same radius has the same refractive index, and the refractive index of the medium material filled increases gradually with the radius).

The substrate 501 of the metamaterial sheet layer 500 is made of a ceramic material, a polymer material, a ferroelectric material, a ferrite material or a ferro-magnetic material. The polymer material may be chosen from PTFE, an epoxy resin, an F4B composite material, an FR-4 composite material and the like. For example, PTFE has excellent electric insulativity, and thus will not cause interference to the electric field of the electromagnetic wave; and PTFE has excellent chemical stability and corrosion resistance, and thus has a long service life.

The man-made pores 502 may be formed on the substrate through high-temperature sintering, injection molding, stamping, or digitally controlled punching. Of course, for substrates of different materials, the man-made pores are formed in different ways. For example, when the substrate is made of a ceramic material, the man-made pores are preferably formed on the substrate through high-temperature sintering; and when the substrate is made of a polymer material (e.g., PTFE or an epoxy resin), the man-made pores are preferably formed on the substrate through injection molding or stamping.

The man-made pores 502 may be any or a combination of cylindrical pores, conical pores, circular-truncated-cone-like pores, trapezoidal pores and square pores. Of course, the man-made pores 502 may be pores of other forms. The man-made pores in the metamaterial units 504 may be in the same form or different forms depending on different requirements. Of course, the pores of the entire metamaterial are preferably in the same form in order to make the manufacturing process easier.

The metamaterial 300 shown in FIG. 6 comprises a plurality of metamaterial sheet layers 500 shown in FIG. 4. There are shown three metamaterial sheet layers. Of course, the metamaterial 300 may be comprised of a different number of metamaterial sheet layers 500 depending on different requirements. The plurality of metamaterial sheet layers 500 are joined closely with each other, and this may be achieved through use of double-sided adhesive tapes or bolts.

The embodiments of the present disclosure have been described above with reference to the attached drawings; however, the present disclosure is not limited to the aforesaid embodiments, and these embodiments are only illustrative but are not intended to limit the present disclosure. Those of ordinary skill in the art may further devise many other implementations according to the teachings of the present disclosure without departing from the spirits and the scope claimed in the claims of the present disclosure, and all of the implementations shall fall within the scope of the present disclosure.

What is claimed is:

1. A metamaterial for diverging an electromagnetic wave, comprising at least one metamaterial sheet layer, wherein refractive indices of the metamaterial sheet layer are distributed in a circular form with a center of the metamaterial sheet layer, and the refractive indices remain unchanged at a same radius and increase gradually with the radius; wherein the metamaterial sheet layer comprises a plurality of metamaterial units, each of the metamaterial units comprises a substrate and microstructures disposed on the substrate, the microstructures are man-made pores, for a same one of the metamaterial sheet layer, all the man-made pores are filled with a medium material having a refractive index which is smaller than that of the substrate, each of the metamaterial units comprises one man-made pore, the man-made pores of the metamaterial units at a same radius have a same volume, the man-made pores gradually decrease in volume as the radius increases, and the radius represents a distance from the respective metamaterial unit to the center of the metamaterial sheet layer.

2. The metamaterial of claim 1, wherein the refractive indices increase with the radius in a linear way, a squared way or a cubic way.

3. The metamaterial of claim 1, wherein the man-made pores are any or a combination of cylindrical pores, conical pores, circular-truncated-cone-like pores, trapezoidal pores and square pores.

4. The metamaterial of claim 1, wherein the man-made pores are formed on the substrate through high-temperature sintering, injection molding, stamping, or digitally controlled punching.

5. The metamaterial of claim 1, wherein the substrate is made of a ceramic material, a polymer material, a ferroelectric material, a ferrite material or a ferro-magnetic material.

6. The metamaterial of claim 5, wherein the polymer material includes polytetrafluoroethylene (PTFE), an epoxy resin, an F4B composite material or an FR-4 composite material.

7. The metamaterial of claim 1, wherein each of the metamaterial units is of a cubic or cuboidal form, and none of a length, a width and a height of the metamaterial unit is greater than one fifth of a wavelength of the incident electromagnetic wave.

8. A metamaterial for diverging an electromagnetic wave, comprising at least one metamaterial sheet layer, wherein refractive indices of the metamaterial sheet layer are distributed in a circular form with a center of the metamaterial sheet layer, and the refractive indices remain unchanged at a same radius and increase gradually with the radius; wherein the metamaterial sheet layer comprises a plurality of metamaterial units, each of the metamaterial units comprises a substrate and microstructures disposed on the substrate, the microstructures are man-made pores, for a same one of the metamaterial sheet layer, all the man-made pores are formed of unit pores having a same volume and are filled with a medium material having a refractive index which is smaller than that of the substrate, a total volume of the man-made pores is the same for each of the metamaterial units at a same radius, the number of the unit pores in each of the man-made pores decreases gradually as the radius increases, and the radius represents a distance from the respective metamaterial unit to the center of the metamaterial sheet layer.

9. A metamaterial for diverging an electromagnetic wave, comprising at least one metamaterial sheet layer, wherein refractive indices of the metamaterial sheet layer are distributed in a circular form with a center of the metamaterial sheet layer, and the refractive indices remain unchanged at a same radius and increase gradually with the radius; wherein the metamaterial sheet layer comprises a plurality of metamaterial units, each of the metamaterial units comprises a substrate and microstructures disposed on the substrate, the microstructures are man-made pores, for a same one of the metamaterial sheet layer, all the man-made pores are filled with a medium material having a refractive index which is greater than that of the substrate, each of the metamaterial units comprises one man-made pore, the man-made pores of the metamaterial units at a same radius have the same volume, the man-made pores gradually increase in volume as the radius increases, and the radius represents a distance from the respective metamaterial unit to the center of the metamaterial sheet layer.

10. A metamaterial for diverging an electromagnetic wave, comprising at least one metamaterial sheet layer, wherein refractive indices of the metamaterial sheet layer are distributed in a circular form with a center of the metamaterial sheet layer, and the refractive indices remain unchanged at a same radius and increase gradually with the radius; wherein the metamaterial sheet layer comprises a plurality of metamaterial units, each of the metamaterial units comprises a substrate and microstructures disposed on the substrate, the microstructures are man-made pores, for a same one of the metamaterial sheet layer, all the man-made pores are formed of unit pores having a same volume and are filled with a medium material having a refractive index which is greater than that of the substrate, a total volume of the man-made pores is the same for each of the metamaterial units at a same radius, the number of the unit pores in each of the man-made pores increases gradually as the radius increases, and the radius represents a distance from the respective metamaterial unit to the center of the metamaterial sheet layer.

11. A metamaterial for diverging an electromagnetic wave, comprising at least one metamaterial sheet layer, wherein refractive indices of the metamaterial sheet layer are distributed in a circular form with a center of the metamaterial sheet layer, and the refractive indices remain unchanged at a same radius and increase gradually with the radius; wherein the metamaterial sheet layer comprises a plurality of metamaterial units, each of the metamaterial units comprises a substrate and microstructures disposed on the substrate, the microstructures are man-made pores, for a same one of the metamaterial sheet layer, the man-made pores all have a same volume, a medium material filled at a same radius has the same refractive index, the refractive index of the medium material filled in the man-made pores increases gradually with the radius, and the radius represents a distance from the respective metamaterial unit to the center of the metamaterial sheet layer.

* * * * *